US006234201B1

(12) United States Patent
Strobel

(10) Patent No.: US 6,234,201 B1
(45) Date of Patent: May 22, 2001

(54) VALVE ARRANGEMENT

(75) Inventor: Georg Strobel, Obertraubling (DE)

(73) Assignee: Knapp MicroFluid, GmbH (DE)

( * ) Notice: Subject to any disclaimer, the term of this patent is extended or adjusted under 35 U.S.C. 154(b) by 0 days.

(21) Appl. No.: 09/346,676

(22) Filed: Jul. 2, 1999

(30) Foreign Application Priority Data

Jul. 2, 1998 (DE) ..... 198 29 530

(51) Int. Cl.[7] ..... F15B 13/04; F15B 11/044

(52) U.S. Cl. ..... 137/596; 91/420; 137/884; 137/886

(58) Field of Search ..... 137/596, 884, 137/886; 91/420

(56) References Cited

U.S. PATENT DOCUMENTS 4,377,183 * 3/1983 Johansson et al. ..... 137/884 X
4,382,452 * 5/1983 Loveless ..... 137/884 X
4,462,427 * 7/1984 Neff ..... 137/884 X
4,465,100 * 8/1984 Neff ..... 137/884 X
4,485,846 * 12/1984 Neff ..... 137/884 X
4,509,556 * 4/1985 Scanlon ..... 137/884
4,574,844 * 3/1986 Neff et al. ..... 137/884 X
4,709,724 * 12/1987 Williams ..... 137/596
4,770,209 * 9/1988 Neff ..... 137/884
6,131,610 * 10/2000 Morisako et al. ..... 91/420 X

* cited by examiner

*Primary Examiner*—Gerald A. Michalsky
(74) *Attorney, Agent, or Firm*—Hoffman Wasson & Gitler PC

(57) ABSTRACT

A valve arrangement using at least two piston slide valves flanged in series with their valve housings. The number of required line holes are reduced as are the number of sealing sites.

4 Claims, 5 Drawing Sheets

VALVE ARRANGEMENT

BACKGROUND OF THE INVENTION

The invention relates to a valve arrangement.

Valve arrangements using piston slide valves are known. The disadvantage of these known valve arrangements is that when additional functions are necessary for all or some fluid outlets, this leads to a relatively complex and expensive structure. One of these complex structures is a plate design which requires a plurality of partially very long holes and/or holes which adjoin one another at an angle, as fluid channels and a plurality of sealing sites, etc.

Compared to seat valves, piston slide valves have certain advantages, in that with a small structure relatively large flow cross sections can be accomplished, and in this way pressure drops in fluid systems can be reduced.

Furthermore, generic type valve arrangements are known in which to achieve a simplified structure, while preserving the basic advantages of piston slide valves, several slide valves or their housings are flanged in series, or without an additional valve plate, directly to a valve arrangement.

The object of the invention is to devise a valve arrangement with at least two piston slide valves flanged in series with their valve housings, in which (valve arrangement) the valves have optimum behavior, especially optimum dynamic behavior.

SUMMARY OF THE INVENTION

For the purposes of this invention a "fluid" is defined as a liquid or hydraulic medium, for example, an oil or a hydraulic medium based on another liquid, for example a water-based medium.

The piston slide valves, or their connections, can be made with an additional fluid function. These functions are, for example, additional closing and blocking functions, pressure and/or flow functions, and/or the function of a pilot-controlled check valve, a presser limiter, or a choker check valve.

In the invention, by accommodating the additional functions in the respective valve housing of the piston slide valve, it is possible to interconnect the individual piston slide valves, or their valve housings, by simple flanging in terms of fluid to a valve arrangement.

For the purposes of the invention "flanging" also means that the holes provided in the valve housings, which are made as through holes, and which are open on the connection surfaces, form distributor channels which extend through the valve arrangement for supplying the pressurized fluid (P-channels) and for discharging the fluid, for example, to a tank or to a reservoir (tank channels).

The valve housings in the invention are preferably made cuboidal, in a form such that in one axial direction they have, perpendicular to the connection surfaces, a width as small as possible, so that only very short holes are necessary for the channels for supplying and discharging the fluid.

The invention enables, while retaining the basic advantages of piston slide valves, and with optimum behavior, also the dynamic behavior of the valves, a small and compact, and mainly simplified structure of the valve arrangement, by reducing the number of required line holes and the number of sealing sites. In addition, a special connection plate (series connection plate) for mounting the piston slide valves is not necessary.

BRIEF DESCRIPTION OF THE DRAWINGS

The invention is detailed below as depicted in the following figures.

DETAILED DESCRIPTION OF THE INVENTION

Figure 1:
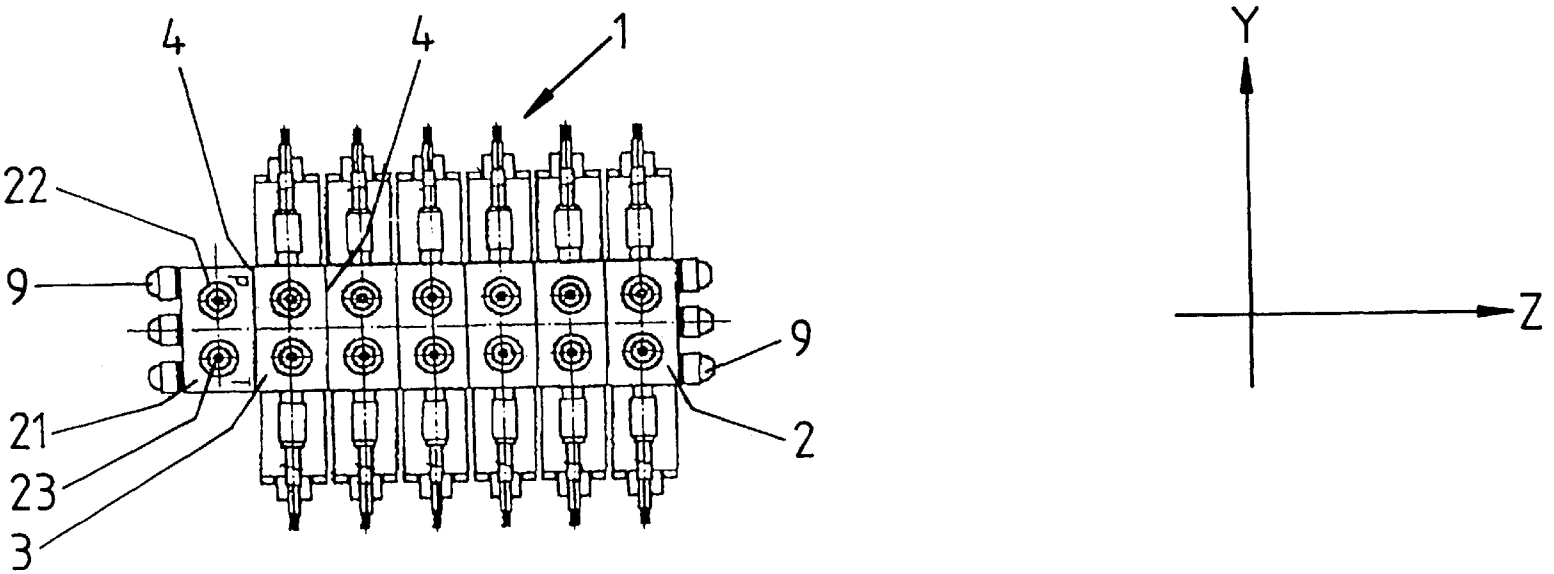
FIG. 1 shows an overhead view of a valve arrangement.
Figure 2:
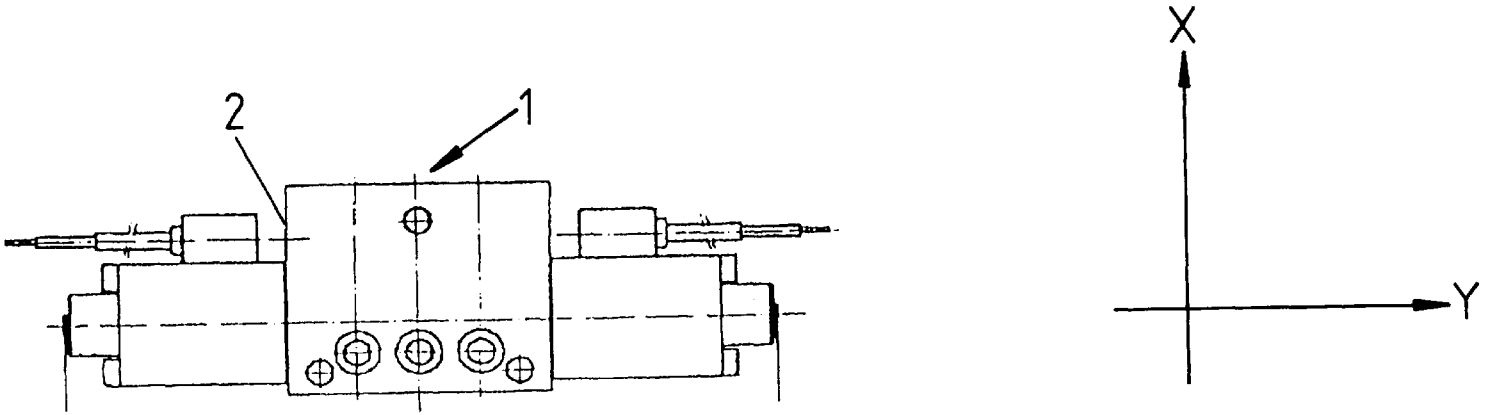
FIG. 2 shows the valve arrangement of FIG. 1 in a side view.

FIGS. 1 and 2 show a valve arrangement 1 which is formed by several piston slide valves 2 which are flanged in series to one another to the valve arrangement 1, with their valve housings 3. At least some of the piston slide valves 2 have in addition to the pure blocking and opening function, other functions, for example, the piston slide valve shown in FIG. 3 also has the function of corresponding check valves.

For a better explanation of the figures, three space coordinates are depicted which run perpendicular to one another, specifically the X-axis, the Y-axis and the Z-axis. The valve housings 3 adjoin one another in the direction of the Z-axis, i.e. they are flanged to one another in series in this axial direction.

The valve housings 3 of the piston slide valves 2 are each made as cuboidal blocks, with two larger housing sides or connection surfaces 4 which are spaced apart and which are located parallel to one another, with a housing top 5, a housing bottom 6, and two opposite housing faces 7 and 8, the housing sides 5–8 each adjoining one another at a right angle and also lying at right angles to the housing surfaces 4. In the direction of the Z-axis, the valve housing 3 is made relatively narrow. i.e. in this axial direction the valve housings have the smallest dimension.

The valves 2 are flanged using through studs 9 such that two adjacent valve housings 3 at a time tightly adjoin one another with their flat connection sides 4. For the studs 9 there are holes 10 in the valve housings 3 which with their axes are perpendicular to the plane (X-Y plane) of the housing surfaces 4. In a chamber 11 which is provided in the respective valve housing 3 and which lies perpendicularly with its axis to the two housing faces 7 and 8 (in the Y-axis) and which is open on both faces, there is a slide 12 which can move axially and, which in the manner known of piston slide valves, has three pistons, specifically, the middle piston 13 and two outer pistons 13' and 13' which form two valve spaces 14 and 15 in the chamber 11 between themselves. The outer pistons 13' and 13" are each surrounded by an anterior valve space or annulus 14' and 15'.

The slide 12 can be moved in three positions by the magnets 16 and 17 provided on the housing faces 7 and 8, specifically

- into a first neutral position, in which the middle piston 13 closes the valve opening to a P-channel 18 which routes pressurized fluid, and the two outer pistons 13' and 13" open the valve spaces 14 and 15 via the annuli 14' and 15' each towards a T-channel 19 and 20,
- into a second position in which via the valve opening the P-channel 18 is connected to the valve space 14 and the valve space 15 is connected to the T-channel 20, and
- into a third position in which the valve space 15 is connected to the P-channel 18 and the valve space 14 is connected to the T-channel 19.

Channels 18–20 are each formed by holes in the valve housing 3 which lie with their axis in the Z-axis and thus perpendicular to the housing surfaces 4. The valve opening to the P-channel is formed by a notch of the hole 18*a* in the area of the chamber 11. The annulae 14' and 15' are connected to the T-channels 19 and 20. All P-channels 18 and all T-channels 19 and 20 of all valve housings 3 which are flanged in series are congruent so that these channels or holes add to a through P-channel and to through T-channels for the valve arrangement 1. These channels on the housing surfaces 4 are sealed to the outside by seals which are not shown. On one end of the valve arrangement, the channels 18–20 are sealed tight by suitable means, for example, by a sealing plate using seals. On the other end of the valve arrangement, or the series-flanged valve housings 3, there is a connection piece 21 which, in its dimensions, corresponds to a valve housing 3 and with its top, bottom and faces is congruent to the corresponding sides of the series-flanged valve housings 3. On the top, the connection piece 21 has a P-connection 22 and a T-connection 23.

On the top of each valve housing 3, there are two connections, or outlets 24 and 25, which, in the same way as the connections of the connection piece 21, are offset against one another in the Y-axis and which are made in the same way as the P-connection 22 and the T-connection 23. In the embodiment shown, the outlet 24 is assigned to the valve space 14 and the output 25 to the valve space 15.

Figure 3:
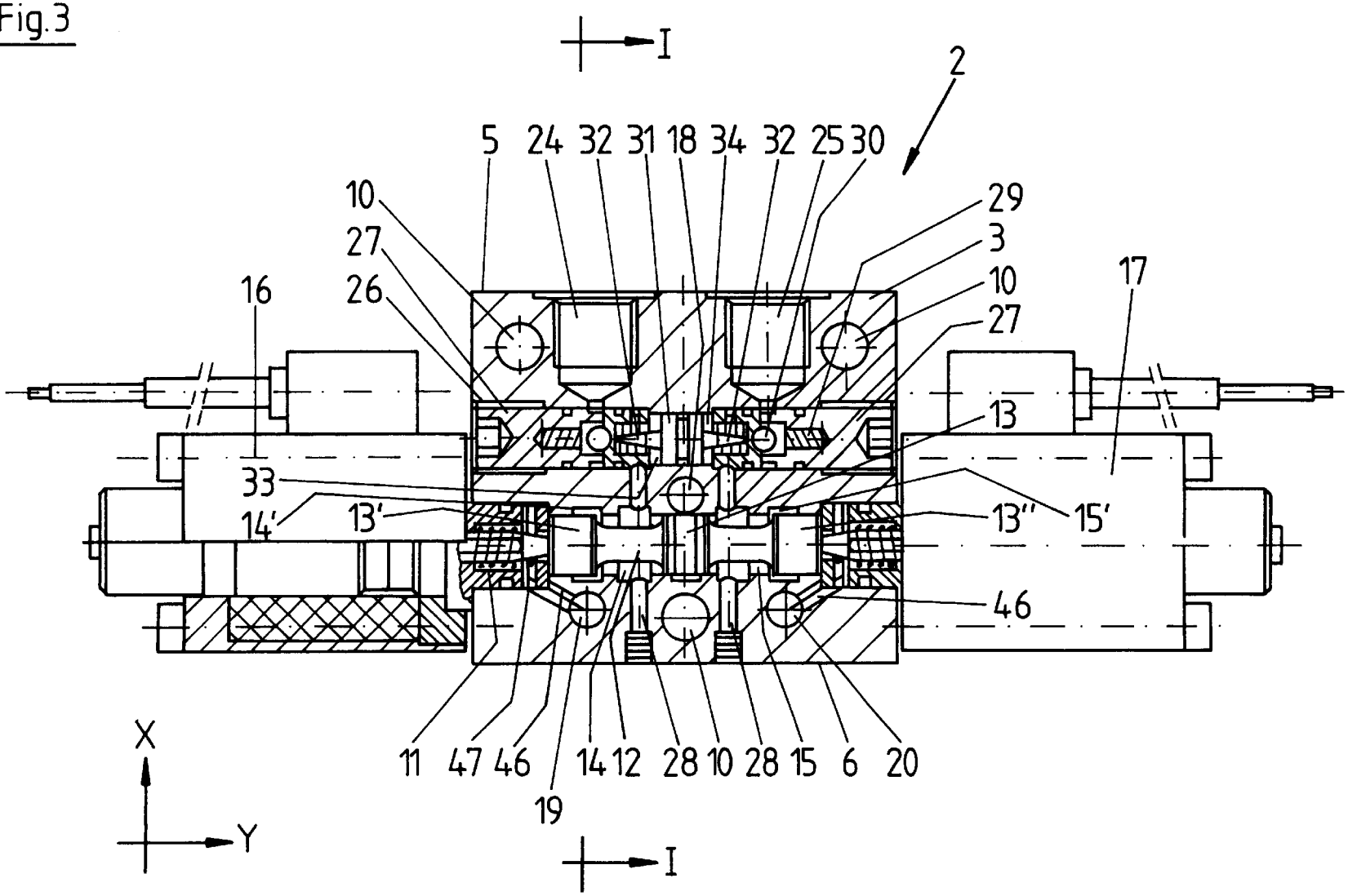
FIG. 3 shows in a simplified representation and partially in section, one of the series flange valves of the valve arrangement from FIG. 1 which are made as piston slide valves.

In the valve housing 3 of the valve 2 shown in FIG. 3, above the chamber 11 there is another chamber 26 which is formed by a through hole and which is used to hold other function elements which are provided between the valve space 14 and the connection 24 and the valve space 15 and the outlet 25.

One insert 27, which forms a corresponding pilot-controlled check valve, is screwed from each side into the chamber 26 which lies with its axis parallel to the Y-axis. The check valves lie in the fluid connection paths, which are formed, between the valve chamber 14 and the output 24, or between the valve chamber 15 and the output 25, partially in the corresponding insert 27 and partially in the valve housing 3 by channels or connections 28 there. The pilot-controlled check valves consist of a ball 30 which is under the action of a valve spring 29 and which is pressed by the springs against one valve seat of the insert 27. The valve seats of the two inserts face one another. Between the inserts 27 in the chamber 26, there is a piston 31 which can move axially. The piston 31 has two plungers 32 which are coaxial to the piston axis and which each project over one of the piston surfaces and of which one plunger interacts with the ball 30 of the insert which is the left one in FIG. 3 and the other plunger interacts with the ball 30 of the right insert. The respective plunger 32 extends in an open channel of the respective insert 27, in which (channel) the check valve formed by the ball and spring is located and which is connected to a control space 33 and 34 which has been formed between the piston 31 and the pertinent insert 27. The control space 33 is connected via a channel 28 to the valve space 14 and the control space 34 is connected via the channel 28 to the valve space 15.

If the slide 12 is in the first neutral position, the two check valves of the inserts 27 are closed, i.e. backflow of the fluid out of the lines connected to the outputs 24 and 25, fluid components, etc, is not possible.

If the slide 12 moves into its second working position and the valve space 14 is filled with the pressurized fluid, the piston 31 is pushed to the right by this fluid and the check valve in the connection to the output 25 is opened, so that on the one hand, via the automatically opening check valve in the left insert 27, pressurized fluid can discharge to the fluid components connected to the output 24 and on the other hand, fluid at the connection 25 can discharge via the opened check valve in the right insert 27 and via the valve space 15 to the T-channel 20.

In the third position of the slide 12, in a similar manner via the piston 31, the check valve assigned to the output 24 is opened.

Figure 4:
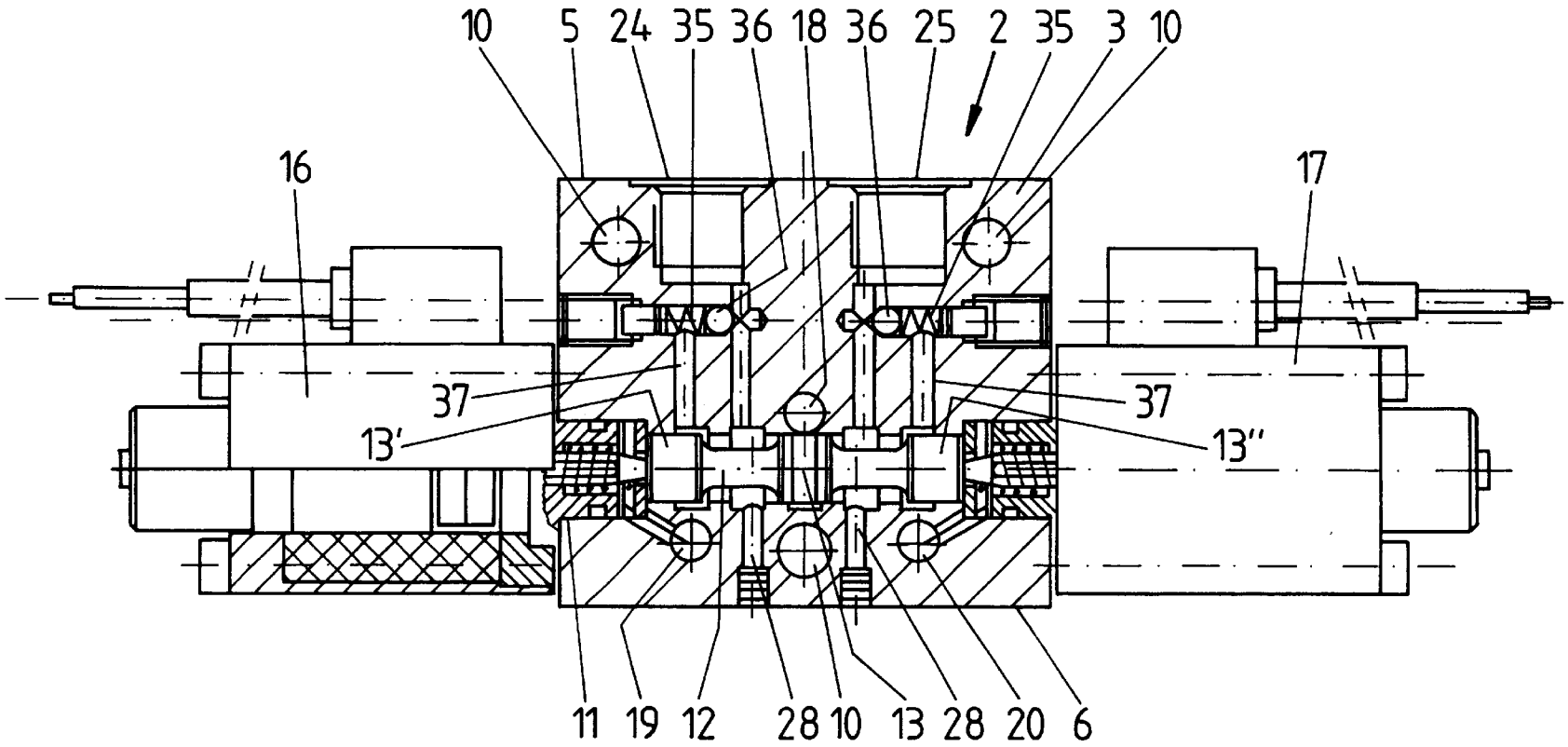
FIGS. 4 and 5 show in a simplified representation other possible embodiments of the series flange valve for use in the valve arrangement of FIG. 1.

In the valve housing 3 other functions can also be integrated, for example, overpressure safeguard, as is shown in FIG. 4 and in which in one branch of the connection (channel 28) which leads directly from the valve spaces 14 and 15 to the pertinent output 24 and 25, there is a valve body which is formed by a ball 36 and which is pretensioned by a spring 35 and which, when a set pressure threshold or one adjusted by the pretensioning of the spring 35 is exceeded, opens the channel 28 to the T-channel 19 and 20 via a relief channel 37.

Figure 5:
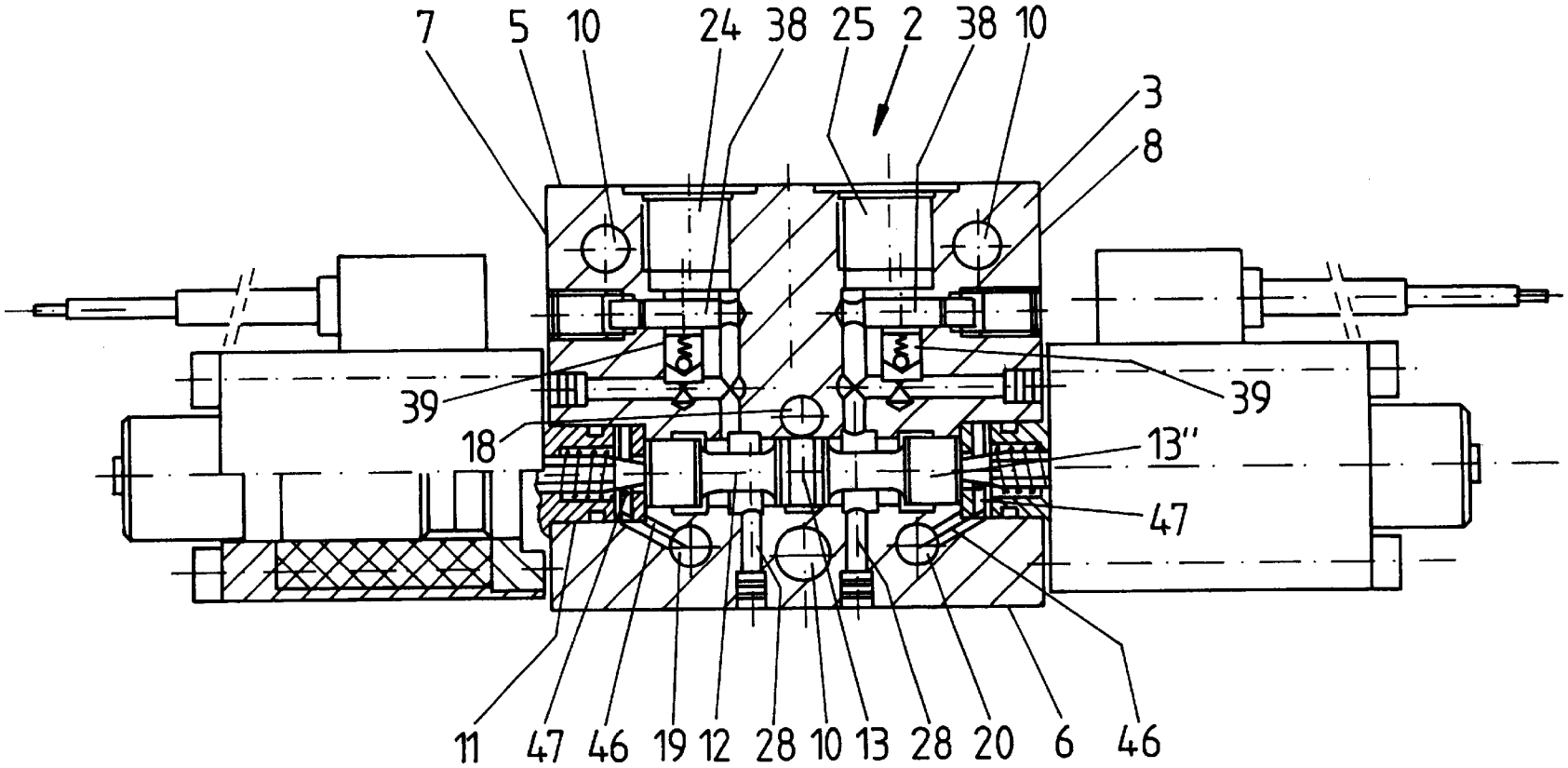

FIG. 5 shows another possible embodiment in a very schematic form. A choking check valve function integrated into the valve housing 3 of the piston slide valve 2 for each output 24 and 25, which is implemented by one choke 38 and parallel to it a check valve 39 being located in the channel or flow path 28 between the valve space 14 and the output 24 and the valve space 15 and output 25 is shown. The check valve opens in the flow direction from the valve space 14 to the output 24, or from the valve space 15 to the output 25, and blocks for flow in the opposite direction.

Figure 7:
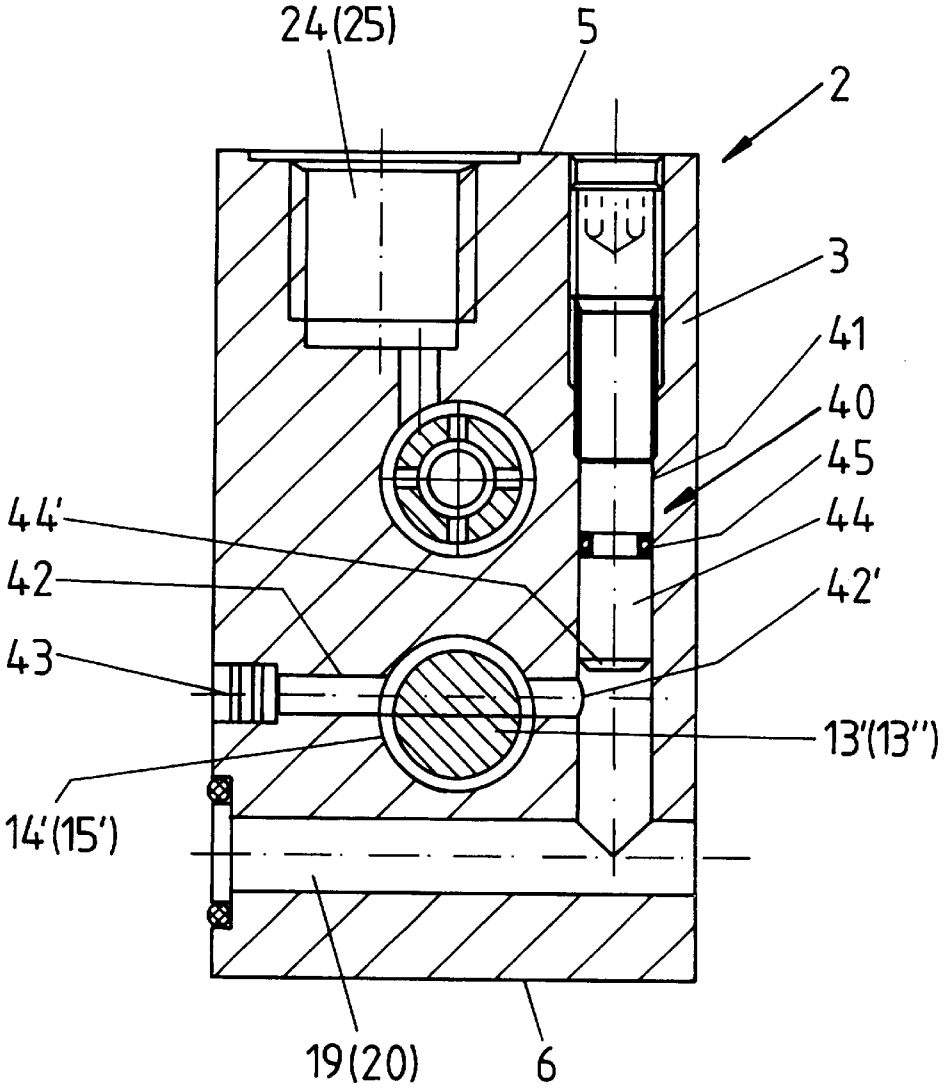
FIG. 7 shows a section according to line I—I of FIG. 3.
Figure 6:
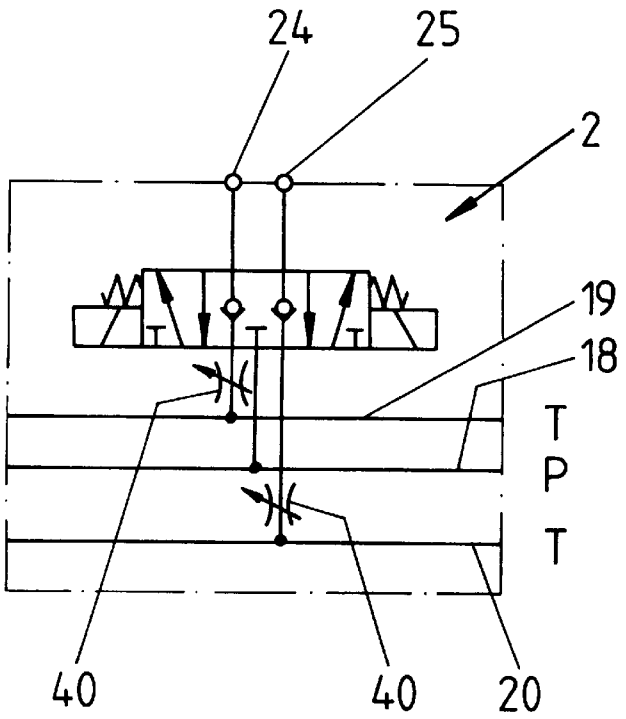
FIG. 6 shows a function diagram of the valve from FIG. 3.

FIG. 6 shows, in a very simplified representation, the functional diagram of the piston slide valve 2 of FIG. 3. One particularity of this valve consists in that the tank channels 19 and 20 are each connected via an adjustable choke 40 with the annulus 14' or 15' which surrounds the respective outer piston 13' and 13". To implement the choke 40, according to FIG. 7, there are two holes 41, each made in the block, which form the valve housing 3. The two holes 41 lie with their axes each in the X-axis and in a common XY plane in the vicinity of the one housing side surface 4, i.e.

offset relative to the lengthwise axis of the chamber 11 in the direction of the Z-axis.

Each hole 41, made as a blind hole, is open on the top 5. With its lower end, each hole 41 discharges in one of the two tank channels 19 and 20, i.e. in the embodiment shown, the axis of one hole 41 intersects the axis of the tank channel 19 and the axis of the other hole 41 intersects the axis of the tank channel 20.

A branch channel 42, which lies with its axis in the direction of the Z-axis, intersects the respective hole 41 and the chamber 11 in the area of the annulus 14' and 15'. The branch channel 42 is made as a blind hole such that it discharges with its one end into the hole 41. On the other end the branch channel 42 is sealed tight by a closure 43. In the hole 41 a choke body is located with a capacity to move axially and to be adjusted. The choke body 44 has an outside thread which fits into the inside thread of the hole 41. Furthermore, on the choke body 44 is a sealing ring 45. Depending on the axial adjustment of the choke body 44, its lower end 44' blocks the notch 42' of the branch channel 42 which acts as a choke opening more or less dramatically. Since the choke screw, or the choke element 44, is accessible on the top 5, the action of the choke 40 can be set separately with the valve arrangement installed for each valve for each tank line or for each tank channel 19 and 20. Another channel is labelled 46 and connects the space 47 on the respective face of the slide 12 on which the respective electromagnet 16 and 17 acts unchoked to the tank channel 19 and 20.

Using chokes 40 yields much better behavior, especially dynamic behavior of the piston slide valves 2, especially when, for example, on one piston triggered via a valve 2, for example, by a sudden load change, forces occur which produce a brief or periodic negative pressure on the connection 24 and 25 which is connected to the P-channel 18. The choke 40 in these situations prevents fluttering or oscillation of the slide 12.

Above, the execution with respect to the choke 40 was described for the piston slide valve 2 shown in FIG. 3. The piston slide valves 2 of FIGS. 4 and 5 have the same execution so that the aforementioned also applies to FIGS. 4 and 5.

The invention was described above using several preferred embodiments. Modifications are possible without departing from the idea underlying the invention. When using piston slide valves, the required additional functions are integrated in the respective valve housing 3 so that the piston slide valves 2 or their housings 3 can be flanged to the valve arrangement. This yields an especially simple and compact structure, in spite of the additional functions and while retaining the basic advantages of piston slide valves which consist in the flow cross section which is relatively large compared to seat valves, and low pressure drop.

Compared to a conventional plate construction, the design is very simple, especially by the reduction of the number of line holes or channels, the number of sealing sites, etc.

REFERENCE NUMBER LIST

1 valve arrangement
2 piston slide valve
3 valve housing
4 housing side surface
5 housing top
6 housing bottom
7, 8 housing face
9 stud
10 hole
11 chamber
12 slide
13, 13', 13" piston
14, 15 valve space
14', 15' annulus
16, 17 electromagnet
18 P-channel
19,20 T-channel
18*a*, 19*a*, 20*a* hole
21 connecting piece
22 P-connection
23 T-connection
24, 25 outlet
26 chamber
27 insert
28 channel
29 valve spring
30 valve ball
31 control piston
32 plunger
33,34 control space
35 valve spring
36 valve ball
37 relief channel
38 choke
39 check valve
40 choke
41 hole for the choke element
42 branch channel
42' notch
43 closure
44 choke element
44' end
45 seal
46 channel
47 space

What is claimed is:

1. A valve arrangement with at least two piston slide valves, each piston slide valve comprising:

(a) a housing;

(b) two fluid outlets on said housing, each of said two fluid outlets being connected to a valve chamber of the piston slide valve;

(c) a first hole in said housing;

(d) two second holes in said housing;

(e) a valve piston slidable in said housing for providing a controlled fluid connection of each fluid outlet either to said first hole or to one of said second holes;

said at least two piston slide valves being flanged in series to said valve arrangement with valve housings of adjacent piston slide valves joining one another in such a way, that said first holes in the valve housing adjoins to form a first distributor channel for supplying a pressurized fluid to the at least two piston slide valves and that the second holes adjoin to form two second distributor channels for discharging the fluid from the at least two piston valves; and (f) a pilot controlled check valves arrangement inside the housing, said check valve arrangement having check valves located between each fluid outlet and an assigned valve chamber of the piston slide valve and a control piston which opens a check valve assigned to one of the fluid outlets, when the other fluid outlet is connected via the piston slide valve to the first distributor channel; and (g) at least one choke in each connection of the piston slide valve to each of the second distributor channels.

2. The valve arrangement as claimed in claim 1, wherein at least one of the fluid outlets of the at least two piston slide valves are located on sides which are flush with one another.

3. The valve arrangement as claimed in claim 1, wherein at least one of the fluid outlets of the at least two piston slide valves are located on tops of the valve housing which are flush to one another.

4. The valve arrangement as claimed in claim 1, wherein at least one choke is adjustable.

* * * * *